US006151747A

United States Patent [19]

Newman et al.

[11] Patent Number: 6,151,747

[45] Date of Patent: Nov. 28, 2000

[54] BRUSH BUMPER

[75] Inventors: Robert D. Newman; Robert D. Newman, Jr., both of P.O. Box 377, Greenwood, Mo. 64034; Buford J. Guittar, Greenwood, Mo.

[73] Assignees: Robert D. Newman; Robert D. Newman, Jr., both of Greenwood, Mo.

[21] Appl. No.: 09/205,303

[22] Filed: Dec. 4, 1998

[51] Int. Cl.[7] ..... A46B 17/08

[52] U.S. Cl. ..... 15/246; 15/175; 15/159.1

[58] Field of Search ..... 15/159.1, 171, 15/175, 184, 246, 325

[56] References Cited

U.S. PATENT DOCUMENTS

| | | |
|---|---|---|
| 941,306 | 11/1909 | Burnside . |
| 1,570,482 | 1/1926 | Hale . |
| 1,695,246 | 12/1928 | Gammeter . |
| 1,918,135 | 7/1933 | Resch . |
| 2,079,367 | 5/1937 | Tringa . |
| 2,153,481 | 4/1939 | Ponselle . |
| 2,262,961 | 11/1941 | Otto . |
| 2,648,090 | 8/1953 | Howard . |
| 2,821,733 | 2/1958 | Kasper . |
| 2,981,966 | 5/1961 | Beffel . |
| 2,986,756 | 6/1961 | Descarries . |
| 3,010,135 | 11/1961 | Pollnow . |
| 3,122,769 | 3/1964 | Doersam . |
| 3,733,635 | 5/1973 | Carden . |
| 4,797,968 | 1/1989 | Wenzlick et al. . |
| 5,280,663 | 1/1994 | Proulx . |
| 5,513,413 | 5/1996 | Myers et al. . |

*Primary Examiner*—Terrence R. Till
*Assistant Examiner*—Jennifer McNeil
*Attorney, Agent, or Firm*—Hovey, Williams, Timmons & Collins

[57] ABSTRACT

A brush bumper (10) is configured to attach to a perimeter ridge (18) of a brush (12). The brush bumper (10) includes a band (22) and a hang tab (24). The band (22) includes a substantially elastic wall (38), which presents an outer face (40), and defines a circumferentially extending channel (52). The hang tab (24), integrally formed with the band (22), includes a pair of opposed recesses (56,58) defining a hanging slot (54). The band (22) is coupled with the brush (12) by inserting the perimeter ridge (18) of the brush (12) into the channel (52).

9 Claims, 2 Drawing Sheets

BRUSH BUMPER

BACKGROUND OF THE INVENTION

1. Field of the Invention

This invention relates to the field of brushes. More particularly, the invention is concerned with elastic band brush bumpers which are attached to the blocks of brushes to prevent scratching and allow for hanging and displaying brushes.

2. Description of the Prior Art

Many people use brushes for different types of cleaning activities. These activities range from cleaning windows and decks, to washing automobiles and boats. A standard brush includes a block and a plurality of bristles. The blocks can be formed from many different materials such as wood, metal, or plastic. Some surfaces on which the brush is intended to be used and other surrounding surfaces are delicate and can be scratched if the block comes into contact with them. To inhibit damage, the corners of the blocks are occasionally covered with bumpers of some type to prevent scratching, but the sides are still left exposed and can mar the finish of the surface being cleaned or damage the surrounding surfaces. Further, the edges of the bumpers catch on cabinet corners and similar obstacles eventually pulling the bumpers off the blocks.

Another problem with standard brushes is the awkwardness of displaying them as merchandise in retail stores. Stores typically have shelving to display their merchandise and prefer to hang merchandise on display hooks. In order to satisfy retailers, a brush manufacturer must surround the brush with packaging to provide structure through which a display hook can extend. The design and materials involved with the packaging increases manufacturing costs.

SUMMARY OF THE INVENTION

The present invention solves the problems mentioned above and provides a distinct advance in the state of the art. In particular, the brush bumper hereof is more economical to manufacture and has a bumper which surrounds the block of a brush to inhibit scratching and more effectively secure the bumper to the block.

The brush bumper of the present invention broadly includes a band having first and second ends and a substantially elastic wall. The wall presents a top, bottom, outer face, and first and second spaced apart inner faces. The wall further defines a circumferentially extending attachment mechanism.

In particularly preferred forms, the band is generally oval in shape, and the attachment mechanism includes a circumferentially extending channel which is generally C-shaped in cross-section and is configured to attach to a perimeter of a brush. The brush bumper further includes a generally arch shaped hang tab integrally formed and attached to the band. The hang tab projects away from the outer face at one end of the band. The hang tab defines a hanging slot.

DETAILED DESCRIPTION OF THE PREFERRED EMBODIMENTS

Figure 2:
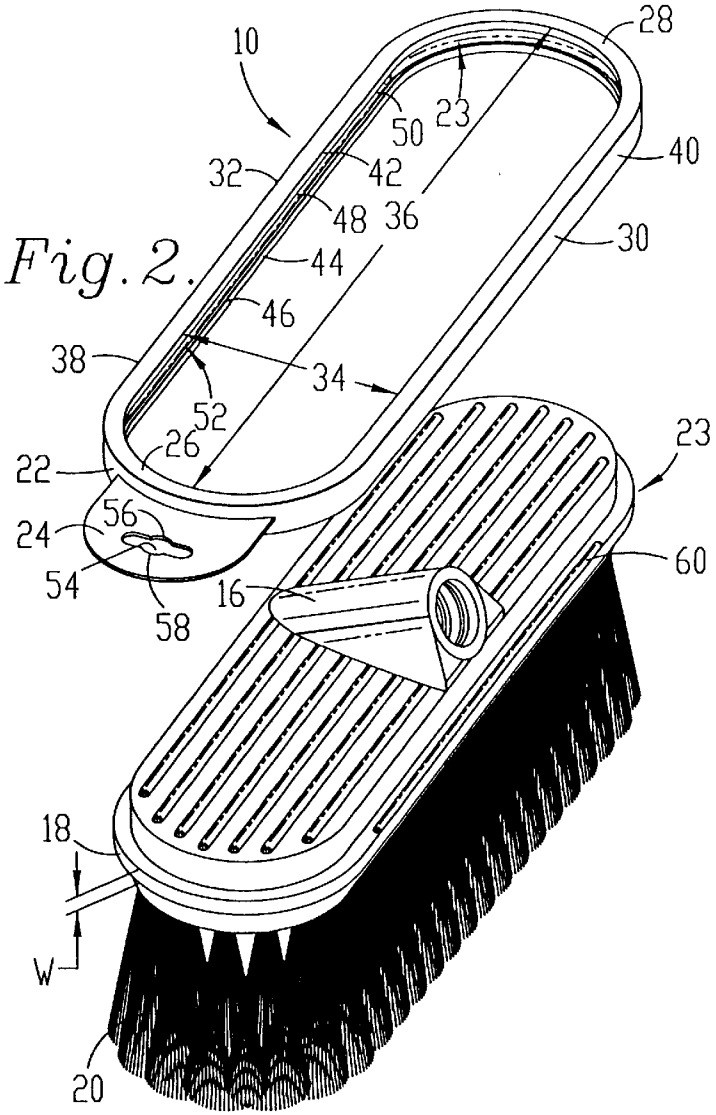
FIG. 2 is an exploded perspective view of the brush and bumper combination of FIG. 1.
Figure 1:
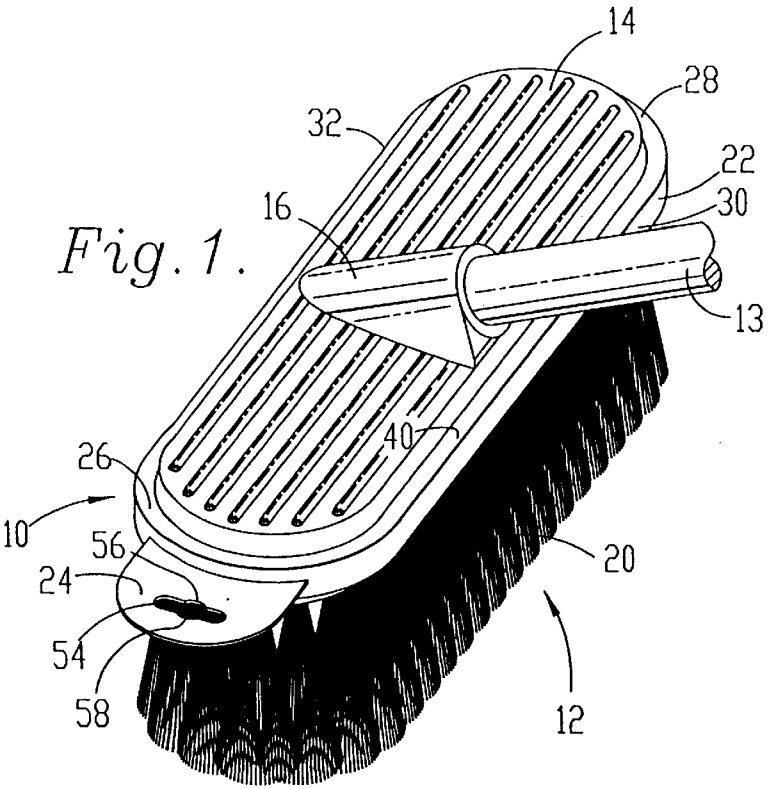
FIG. 1 is a perspective view of the preferred brush bumper in accordance with the present invention in combination with a brush and an extension pole with a portion cut away for clarity of illustration.
Figure 3:
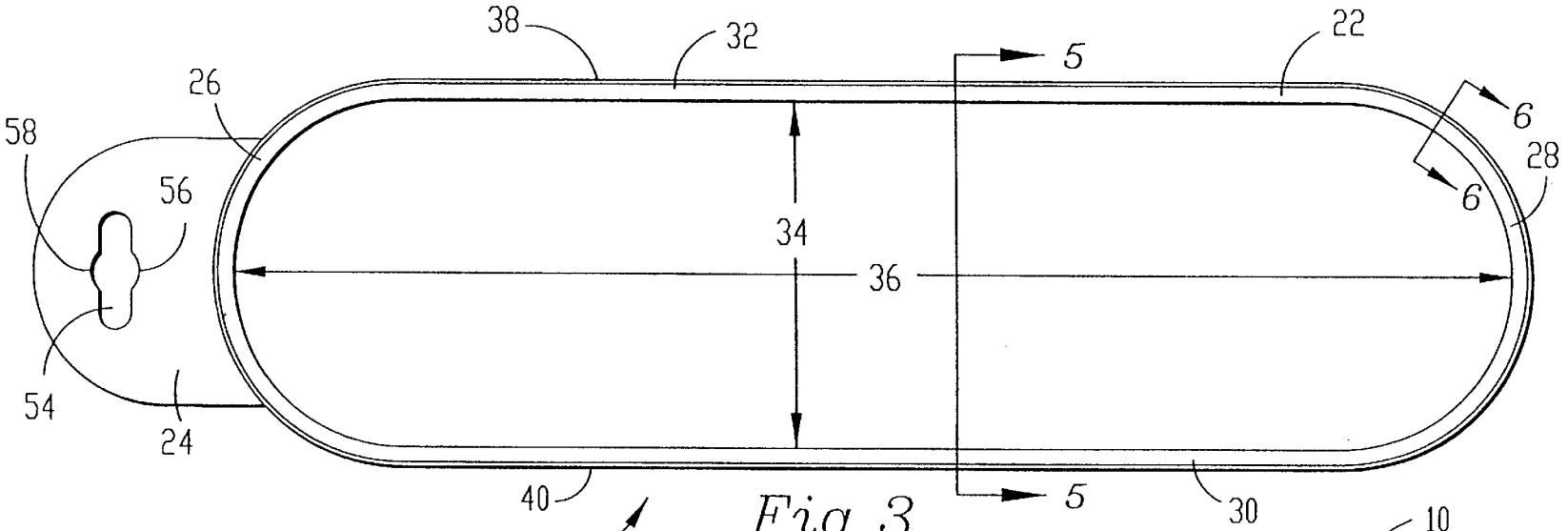
FIG. 3 is a top view of the brush bumper of FIG. 1.
Figure 4:
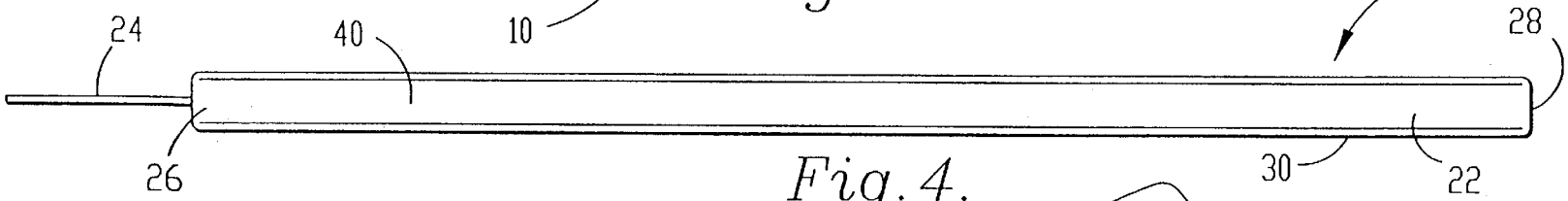
FIG. 4 is a front view of the brush bumper of FIG. 1.

Referring initially to FIGS. 1 and 2, the drawing figures illustrate a preferred brush bumper 10 in combination with a brush 12 and a handle 13 in accordance with the present invention. The brush includes a block 14 having a brush handle connector 16, perimeter ridge 18, and a plurality of bristles 20 extending from the block 14. The brush handle connector 16 is threaded to receive the handle 13. The brush bumper 10 includes a continuous band 22, a portion of an attachment mechanism 23 and a hang tab 24. The brush block 14 includes another portion of the attachment mechanism 23. The band 22 is generally oval shaped and includes first and second ends 26,28, first and second opposed sides 30,32, first and second diameters 34,36 and a substantially elastic wall 38.

Figure 6:
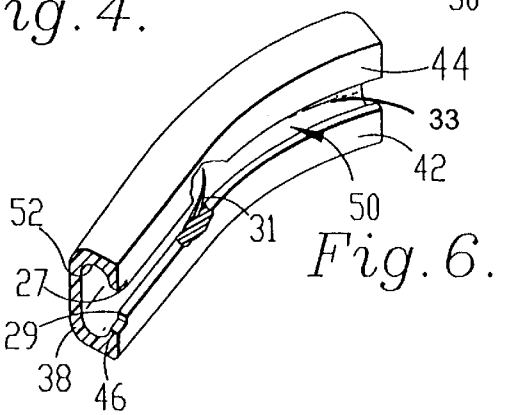
FIG. 6 is a perspective, fragmentary sectional view of a corner of the brush bumper taken along line 6—6 of FIG. 3 and having a portion thereof broken away for illustrative purposes.

The first and second ends 26,28 are spaced apart and separated by the first and second sides 30,32 as shown in FIGS. 1–4. Each end is generally semi-circular in shape and tangentially intersects with the first and second sides 30,32. As shown in FIG. 6, each end includes first and second spaced apart reinforcing inner flanges 27,29 extending from inner faces 42, 44. The inner flanges 27,29 provide stability and help each end 26,28, maintain its shape. Upper and a lower corner support members 31,33 are located at each intersection of the sides 30,32 and ends 26,28. The corner support members 31,33 assist in attaching the reinforcing inner flanges 27,29 to the elastic wall 38. Each corner support member 31,33 is positioned inside the channel 52, spiralling diagnally from the inner flanges relative to the band.

The first and second sides 26,28 are spaced apart and separated by the block 14. The sides 30,32 and ends 36,38 are generally juxtaposed and combine to surround the perimeter of block 14.

Figure 5:
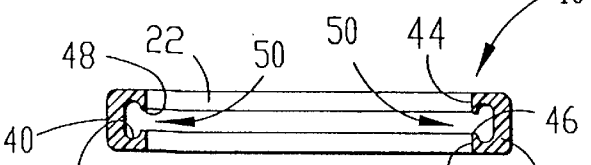
FIG. 5 is a transverse sectional view of the brush bumper taken along line 5—5 of FIG. 3.

As shown in FIG. 5, the wall 38, generally C-shaped in cross-section, presents an outer face 40, and first and second spaced apart inner faces 42,44. The first inner face 42 presents a first edge 46 and the second face 44 presents a second edge 48 spaced apart from the first edge 46 and defining a throat 50 therebetween. The wall 38 further defines a circumferentially extending channel 52 forming a ridge receiving area. The channel 52 is generally oval in transverse cross-section and is bounded in part by the first and second edges 46,48.

Referring to FIGS. 1–4, the hang tab 24 is generally arch shaped and defines a hanging slot 54. The hanging slot 54 extends substantially parallel to the first diameter 34 and is centrally positioned relative to the opposed sides 30,32. The shape of the hanging slot 54 includes first and second opposed recesses 56,58. The recesses 56,58 are shaped as a circle overlaying an elongated slot. The recesses 56,58 are resiliently yieldable to permit a display hook to extend through the hanging slot 54.

The hang tab 24 is integrally formed with and attached to the band 22 and projects away from the outer face 40 preferably extending from one of the ends 26,28 of the band 22. The hang tab 24 has a thickness which is substantially thinner than the thickness of the band 22, and the hang tab 24 is preferably placed at one of the ends 36,38 of the band 22 to allow the brush 12 to be displayed with the minimum amount of deformation and stress placed upon the band 22.

The attachment mechanism 32 attached the brush bumper 10 to the brush 12. Specifically, the channel 52 is configured to receive the perimeter ridge 18 through the throat 50 and past the first and second edges 46,48. The elastic wall 38 is resiliently yieldable, allowing the first and second edges 46,48 to be separated by a distance greater than the width W of perimeter ridge 18. Thus, the edges 46,48 can slide over the perimeter ridge 18 and retain it in the channel 52.

The brush bumper 10 is preferably integrally formed of rubber, although it may be appreciated that other materials having elastic properties could be used. Rubber is preferred for its elasticity, cushioning capabilities, low cost and ease of manufacturing.

The brush bumper 10 is coupled with the brush 12 as shown in FIG. 2 by placing the elastic band 22 over the brush 12 allowing the perimeter ridge 18 to be inserted through the throat 50 into the channel 52. Further, upper and lower rounded securement flanges 60 are preferably formed in upper and lower opposing positions on the ridge 18 of the block and extend into the upper and lower portions of the channel to mate with the band. The securement flanges 60 are preferably positioned along the side of the block where the band has a greater tendency to pull away from the block. The hang tab 24 allows a display hook (not shown) to be inserted through the hanging slot 54 allowing brush 10 to be displayed.

Those skilled in the art will now appreciate the benefits of the present invention. For example, the one piece construction of the hang tab with the band allows a manufacturer to provide a simple way for retail stores to display brushes without the expense of designing and manufacturing packaging. Also, because the band fits around the block, surfaces around the area being clean will be better protected from receiving scratches or blemishes.

Those skilled in the art will also appreciate that the present invention encompasses many variations in the preferred embodiments described herein. The preferred embodiment is generally oval shaped, but could be any shape as long as the band 22 fits substantially around the perimeter of the brush 12. As another example, the illustrated wall 38 is generally C-shaped defining a channel 52, but it could have first and second spaced apart inner faces, defining a dovetail shaped portion. Further, the inner faces can be arcuate. The dovetail shaped extension could be a male attachment mechanism configured to couple with a corresponding female dovetail slot on the perimeter of brush 12. Additionally, the hang tab 24 is attached to one of the ends 26,28 of the band 22, but it could be attached anywhere along the band 22.

Having thus described the preferred embodiments of the present invention, the following is claimed as new and desired to be secured by letters patent:

What is claimed is:

1. A brush bumper configured to attach to a perimeter of a brush, the brush bumper comprising:

a circumferential band including a first and second end and a substantially elastic wall, the wall presenting a top, bottom, outer face, first and second spaced apart inner faces, and an attachment mechanism; and a hang tab attached to the band and projecting away from the outer face, the hang tab defining a hanging slot.

2. The brush bumper as set forth in claim 1, wherein the hang tab and band are integrally formed from rubber.

3. The brush bumper as set forth in claim 1, wherein the hang tab extends from one of the ends of the brush bumper.

4. The brush bumper as set forth in claim 1, wherein the hang tab is generally arch shaped.

5. The brush bumper as set forth in claim 1, wherein the hang tab and the band have a thickness and the hang tab is substantially thinner than the band.

6. A brush bumper in combination with a brush and a handle, the brush including a block, a handle connector and a plurality of bristles extending from the block, the block presenting a perimeter ridge, the brush bumper comprising:

a generally oval band including a first and second end and a substantially elastic wall, the wall presenting an outer face, first and second spaced apart inner faces, and defining a circumferentially extending channel, the first inner face presenting a first edge and the second inner faces presenting a second edge spaced apart from the first edge and defining a throat therebetween; and a generally arch shaped hang tab attached to the band and projecting away from the outer face, the hang tab defining a hanging slot.

7. The brush bumper as set forth in claim 6, wherein the edges are resiliently yieldable to permit insertion of the perimeter ridge of the brush into the channel through the throat.

8. The brush bumper as set forth in claim 6, wherein the channel is generally oval shaped in cross-section.

9. The brush bumper as set forth in claim 6, wherein the hang tab presents first and second opposed recesses defining therebetween the hanging slot, the recesses being resiliently yieldable to permit a display hook to extend through the hanging slot.

* * * * *